US011007393B2

(12) United States Patent
Reinstein et al.

(10) Patent No.: US 11,007,393 B2
(45) Date of Patent: May 18, 2021

(54) VARIABLE WEIGHT EQUIPMENT WITH LIQUID RESISTANCE

(71) Applicant: Nucleus Core LLC, Beverly Hills, CA (US)

(72) Inventors: Fred Reinstein, Los Angeles, CA (US); Diego Calvo, Los Angeles, CA (US)

(73) Assignee: NUCLEUS CORE LLC, Beverly Hills, CA (US)

( * ) Notice: Subject to any disclaimer, the term of this patent is extended or adjusted under 35 U.S.C. 154(b) by 0 days.

(21) Appl. No.: 16/457,618

(22) Filed: Jun. 28, 2019

(65) Prior Publication Data

US 2020/0406085 A1 Dec. 31, 2020

(51) Int. Cl.
*A63B 21/06* (2006.01)
*A63B 21/072* (2006.01)
*A63B 21/00* (2006.01)

(52) U.S. Cl.
CPC ..... *A63B 21/0602* (2013.01); *A63B 21/072* (2013.01); *A63B 21/4035* (2015.10)

(58) Field of Classification Search
CPC ..... A63B 21/0602; A63B 21/4035; A63B 21/0601–0605; A63B 21/4033; A63B 21/00058–00069; A63B 21/00178; A63B 21/001789; A63B 21/072–075;
(Continued)

(56) References Cited

U.S. PATENT DOCUMENTS 7,828,703 B1 11/2010 Boesch
8,454,483 B1 6/2013 Bradley et al.
(Continued)

FOREIGN PATENT DOCUMENTS

GB 2474062 A 4/2011
WO 2019150314 A1 8/2019

OTHER PUBLICATIONS

Wheaton, Oliver, "What are the ingredients of Coca-Cola? (and does it really contain cocaine?)," Aug. 9, 2017, Metro News, 8 pages, retrieved from the Internet: https://metro.co.uk/2017/08/09/what-are-the-ingredients-of-coca-cola-and-does-it-really-contain-cocaine-6840654/ (Year: 2017).*
(Continued)

*Primary Examiner* — Megan Anderson
*Assistant Examiner* — Kathleen Vermillera
(74) *Attorney, Agent, or Firm* — Kilpatrick Townsend & Stockton LLP

(57) ABSTRACT

A fitness device for strength training can include: a clamshell housing including a front portion and a back portion. The front portion and the back portion can mate together to define an internal volume. The clamshell housing includes first handle portions extending circumferentially around the front portion and second handle portions extending circumferentially around the back portion. The first and second handle portions mate together to define a plurality of handles. The fitness device includes a sealed container defining a fluid chamber. The sealed container can be fixedly received within the internal volume defined by the front portion and the back portion of the clamshell housing. The fluid chamber of the sealed container can contain: a gaseous component, a first fluid component, and a second fluid component.

19 Claims, 8 Drawing Sheets

(58) Field of Classification Search
CPC .... A63B 2210/50; A63B 2225/68–682; A45C 11/20; A45F 3/16
See application file for complete search history.

(56) References Cited

U.S. PATENT DOCUMENTS

| | | | | |
|---|---|---|---|---|
| 2005/0224445 | A1* | 10/2005 | Gancia | B65D 51/1677 215/204 |
| 2010/0308040 | A1* | 12/2010 | Simon | A45C 11/20 220/4.22 |
| 2011/0275494 | A1 | 11/2011 | Radi et al. | |
| 2016/0051855 | A1 | 2/2016 | Warren | |
| 2018/0133538 | A1 | 5/2018 | Jones et al. | |
| 2019/0351277 | A1* | 11/2019 | Bassoo | A63B 21/4007 |
| 2020/0147438 | A1 | 5/2020 | Lewis | |

OTHER PUBLICATIONS

Extended European Search Report from European Patent Application No. 20182961.1, dated Nov. 9, 2020, 6 pages.

* cited by examiner

VARIABLE WEIGHT EQUIPMENT WITH LIQUID RESISTANCE

FIELD

The present invention relates to resistance training devices and methods.

BACKGROUND

Weight training is a common type of strength training for developing the strength and size of skeletal muscles. It utilizes the force of gravity in the form of weighted bars, dumbbells or weight stacks in order to oppose the force generated by muscle through concentric or eccentric contraction. Weight training uses a variety of specialized equipment to target specific muscle groups and types of movement.

Strength training is central to several sports, and many more sports include strength training as a part of their training regimen. Strength training is also increasingly important for generally maintaining health and fitness. For example, strength training may help stabilize joints, increase cardiovascular conditioning, improve body-composition, and increase bone density.

Strength training has been performed with many implements. These implements have included objects such as rocks, weight bars, weight plates, dumbbells, kettlebells, or the like. More modern strength training implements include resistance bands. While strength training implements can provide adequate training opportunity, current implements have limitations that prevent users from achieving many benefits of strength training. Thus, further development to strength training implements are desired.

BRIEF SUMMARY

Some aspects of the present disclosure relate to a fitness device. The fitness device can include: a clamshell housing including a front portion and a back portion. The front portion and the back portion can be mated together to define an internal volume. The clamshell housing includes first handle portions extending circumferentially around the front portion and second handle portions extending circumferentially around the back portion. In some embodiments, the first and second handle portions mate together with the mating of the front portion and the back portion to define a plurality of handles. The fitness device includes a sealed container defining a fluid chamber. The sealed container can be fixedly received within the internal volume defined by the front portion and the back portion of the clamshell housing. In some embodiments, the fluid chamber of the sealed container can contain: a gaseous component, a first fluid component, and a second fluid component.

In some embodiments, the first fluid component is water, and in some embodiments the second fluid component is mineral oil. In some embodiments, the sealed container contains a mixture of the first fluid component and the second fluid component in a ratio of 4 parts of the first fluid component to 1 part of the second fluid component. In some embodiments, the first fluid component and the second fluid component together fill between 50 percent and 70 percent of the fluid chamber of the sealed container.

In some embodiments, the front portion has a front external surface and a front internal surface, and in some embodiments the back portion has a back external surface and a back internal surface. In some embodiments, each of the front external surface and the back external surface are convex and wherein each of the front internal surface and the back internal surface are concave.

In some embodiments, at least one of the front internal surface and the back internal surface has an engagement feature engaged with a portion of the sealed container to fix a position of the sealed container with respect to the clamshell housing. In some embodiments, the sealed container has a top and a bottom, and in some embodiments, the top of the sealed container includes a handle portion. In some embodiments, the handle portion includes interior surfaces defining a gripping orifice.

In some embodiments, the engagement feature includes a handle-portion feature. In some embodiments, the handle-portion feature at least partially inserts into the gripping orifice and engages with at least some of the interior surfaces defining the gripping orifice. In some embodiments, the engagement feature includes a base feature engaged with at least a portion of the bottom of the sealed container. In some embodiments, the base feature includes a curved member arched towards and engaged with the bottom of the sealed container. In some embodiments, the curved member is dome-shaped. In some embodiments, the curved member at least partially deforms the bottom of the sealed container.

In some embodiments, each of the first handle portions and the second handle portions has four gripping regions. In some embodiments, the fitness device further includes a plurality of rubber handgrips. In some embodiments, each of the gripping regions is at least partially covered by one of the plurality of rubber handgrips. In some embodiments, the front portion and the back portion are connected via a plurality of mechanical fasteners. In some embodiments, the sealed container includes: a bottle; a seal; a support member; and a cap. In some embodiments, the cap is fused to the bottle.

One aspect of the present disclosure relates to a method of analog-resistance training. The method includes gripping a fitness device having a clamshell housing fixedly housing a sealed container defining a fluid chamber in an internal volume defined by the clamshell housing. In some embodiments, the fluid chamber of the fitness device contains a gaseous portion and a fluid which fluid includes a first fluid portion and a second fluid portion. The method includes repeatedly accelerating the fitness device. In some embodiments, the repeated acceleration of the fitness device generates dynamic force via movement of the fluid within the fluid chamber.

In some embodiments, the fluid includes a first fluid component and a second fluid component. In some embodiments, the first fluid component is water, and the second fluid component is mineral oil. In some embodiments, the sealed container contains a mixture of the first fluid component and the second fluid component in a ratio of 4 parts of the first fluid component to 1 part of the second fluid component. In some embodiments, the first fluid component and the second fluid component together fill between 50 percent and 70 percent of the fluid chamber of the sealed container.

In some embodiments, the clamshell housing has a front, a back, a first side, a second side, a third side, and a fourth side. In some embodiments, the front and the back of the clamshell housing are connected by each of: the first side; the second side; the third side; and the fourth side. In some embodiments, the sealed container includes: a top; a bottom; a front; a back; a left side; and a right side. In some embodiments, the clamshell housing includes: a first grip coupled to the first side; a second grip coupled to the second side; a third grip coupled to the third side; and a fourth grip coupled to the fourth side. In some embodiments, the first grip is proximate to the top of the sealed container, the second grip is proximate to the bottom of the sealed container, the third grip is proximate to the left side of the sealed container, and the fourth grip is proximate to the right side of the sealed container.

In some embodiments, the first grip and the second grip are separated by a first distance, and the third grip and the fourth grip are separated by a second distance. In some embodiments, the first distance is greater than the second distance. In some embodiments, the method includes gripping the fitness device gripping the first grip and the second grip or the third grip and the fourth grip. In some embodiments, gripping the fitness devices includes gripping the first grip and the second grip.

In some embodiments, the method includes regripping the fitness device. In some embodiments, regripping the fitness device includes: releasing the first and second grips; and gripping the third and fourth grips. In some embodiments, the method includes repeatedly accelerating the fitness device while gripping the third and fourth grips. In some embodiments, a first force generated from the repeated acceleration of the fitness device while gripping the first and second grip is different than a second force generated from the repeated acceleration of the fitness devices while gripping the third and fourth grips.

In some embodiments, the clamshell housing comprises an engagement feature engaged with a portion of the sealed container to fix a position of the sealed container with respect to the clamshell housing. In some embodiments, the sealed container has a handle portion, and the handle portion has interior surfaces defining a gripping orifice. In some embodiments, the engagement feature includes a handle-portion feature. In some embodiments, the handle-portion feature at least partially inserts into the gripping orifice and engages with at least some of the interior surfaces defining the gripping orifice. In some embodiments, the engagement feature includes a base feature engaged with at least a portion of the bottom of the sealed container. In some embodiments, the base feature includes a curved member arched towards and engaged with the bottom of the sealed container.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

DETAILED DESCRIPTION

Figure 1:
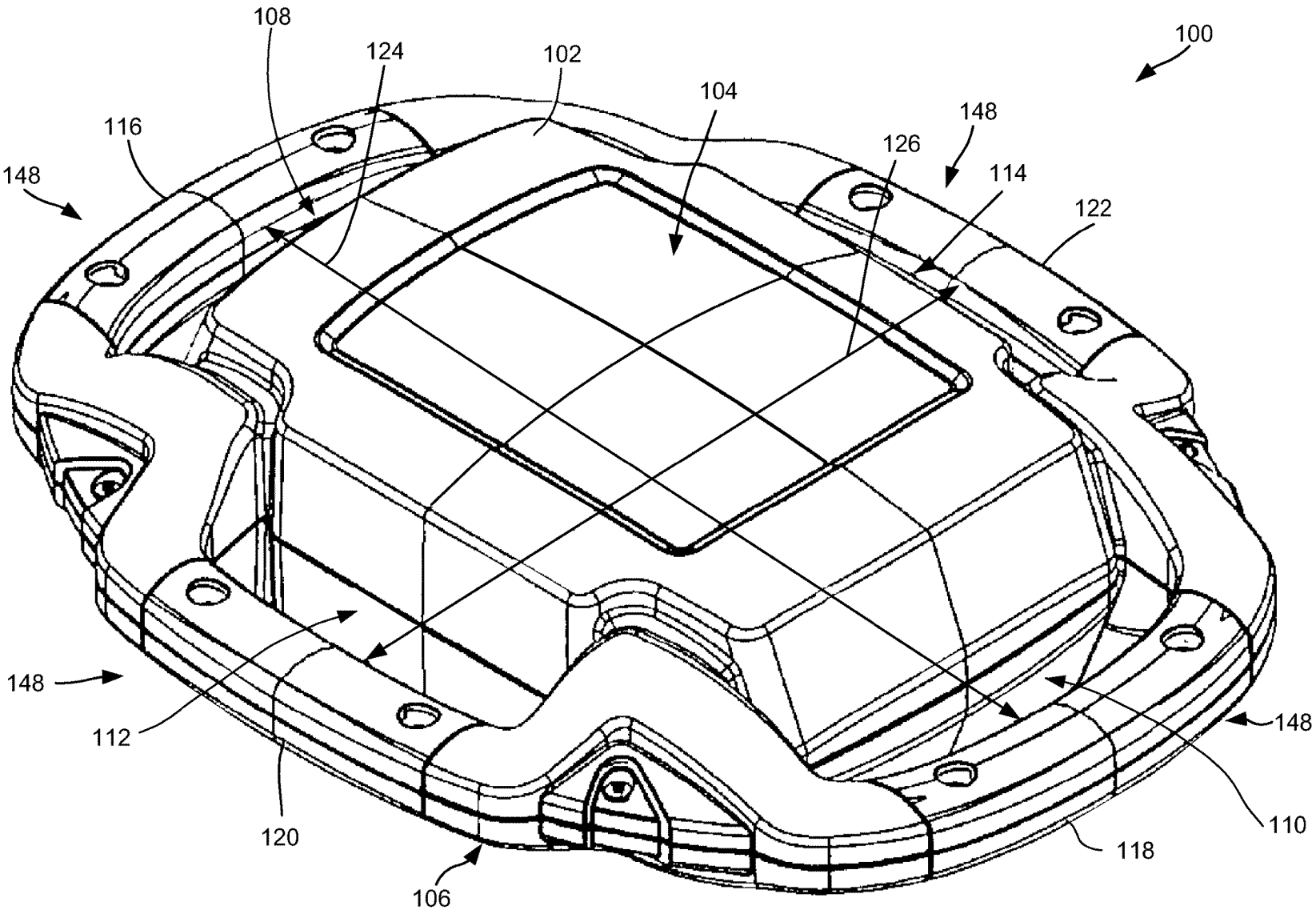
FIG. 1 illustrates a perspective view of one embodiment of a fitness device.

The present invention relates to a fitness device, specifically to a strength training implement and to methods of use of the same. Strength training is frequently performed by the repeated lifting of a heavy object. Typical strength training implements include dumbbells, barbells, weight plates, kettlebells, resistance bands, sandbags, rocks, and machines that can have adjustable resistance. These implements are used in a wide variety of workouts to provide a wide range of training benefits. Some workouts with these implements can include single-joint and/or multi-joint lifts, and/or power-lifts. While these traditional strength training implements are able to deliver many desired benefits, they are limited in some ways.

Strength training strengthens both primary muscles targeted by a lift as well as stabilizer muscles. The stabilizer muscles maintain the stability of the joint(s) moving through the strengthening exercises, as well as other portions of the body of the person performing the strengthening exercise. The strength of these stabilizer muscles is important to performance of an athlete, and to stability and/or security of the athlete's joints.

Although certain exercises, equipment, and/or exercise techniques improve the training of the stabilizer muscles, further improvements are desired. Additionally, traditional strength training implements may, upon rapid acceleration of the implement, place loads on the athlete's joints that can, over time, cause wear to the athlete's joints. Further, use of traditional strength training implements, even in dynamic exercises, provides predictable forces.

The present application relates to a fitness device, and specifically to a strength training implement that solves many of the problems of current strength training implements and/or fitness devices. The fitness device of the present application generates dynamic forces that can be unpredictable. These dynamic forces provide strengthening to stabilizer muscles, decrease loading on joints, and provide benefit to primary muscles targeted by an exercise.

Further, in contrast to current strength training equipment that provides resistance at discrete resistance levels corresponding to available weights or weight plates, also referred to as digital resistance, the present fitness device provides infinite resistance levels based solely on the movements of the user of the fitness device. These infinite resistance levels, also referred to herein as analog resistance, are generated based on the movement of a fluid within the fitness device, the movement caused by the acceleration and/or repeated acceleration of the fitness device. Due to this analog resistance which provides increasing resistance as the acceleration of the fitness device increases, the fitness device can be used for challenging workouts by athletes of a wide range of fitness levels, and in some embodiments, of any fitness level. Further, because of this analog resistance, the fitness device can be used by children as well as aged individuals.

A perspective view of one embodiment of a fitness device 100 according to the present disclosure is shown in FIG. 1. The fitness device 100 includes a clamshell housing 102. The clamshell housing 102 has a front 104, a back 106, a first side 108, a second side 110, a third side 112, and a fourth side 114. As seen in FIG. 1, the front 104 and the back 106 of the clamshell housing 102 are connected by each of the first side 108, the second side 110, the third side 112, and the fourth side 114.

The clamshell housing 102 further comprises a plurality of grips, and specifically includes a first grip 116, a second grip 118, a third grip 120, and a fourth grip 122. The first grip 116 is proximate to and/or coupled to the first side 108 of the clamshell housing 102, the second grip 118 is proximate to and/or coupled to the second side 110 of the clamshell housing 102, the third grip 120 is proximate to and/or coupled to the third side 112 of the clamshell housing 102, and the fourth grip 122 is proximate to and/or coupled to the fourth side 114 of the clamshell housing 102.

The first grip 116 and the second grip 118 are separated by a first distance 124 and the third grip 120 and the fourth grip 122 are separated by a second distance 126. As seen in FIG. 1, the first distance 124 is greater than the second distance 126. In some embodiments, an athlete can grip the fitness device 100 via one or more of the grips 116, 118, 120, 122. Specifically, the athlete can grip a pair of the grips 116, 118, 120, 122, and generally grips a pair formed of the first and second grips 116, 118 or a pair formed of the third and fourth grips 120, 122. In some embodiments, the athlete's selection of grips of the fitness device 100 can affect the forces felt by the athlete during training with the fitness device 100. Thus, in some embodiments, a force generated from the repeated acceleration of the fitness device 100 while gripping the first and second grips 116, 118 is different than a force generated from the repeated acceleration of the fitness device 100 while gripping the third and fourth grips 120, 122.

Figure 2:
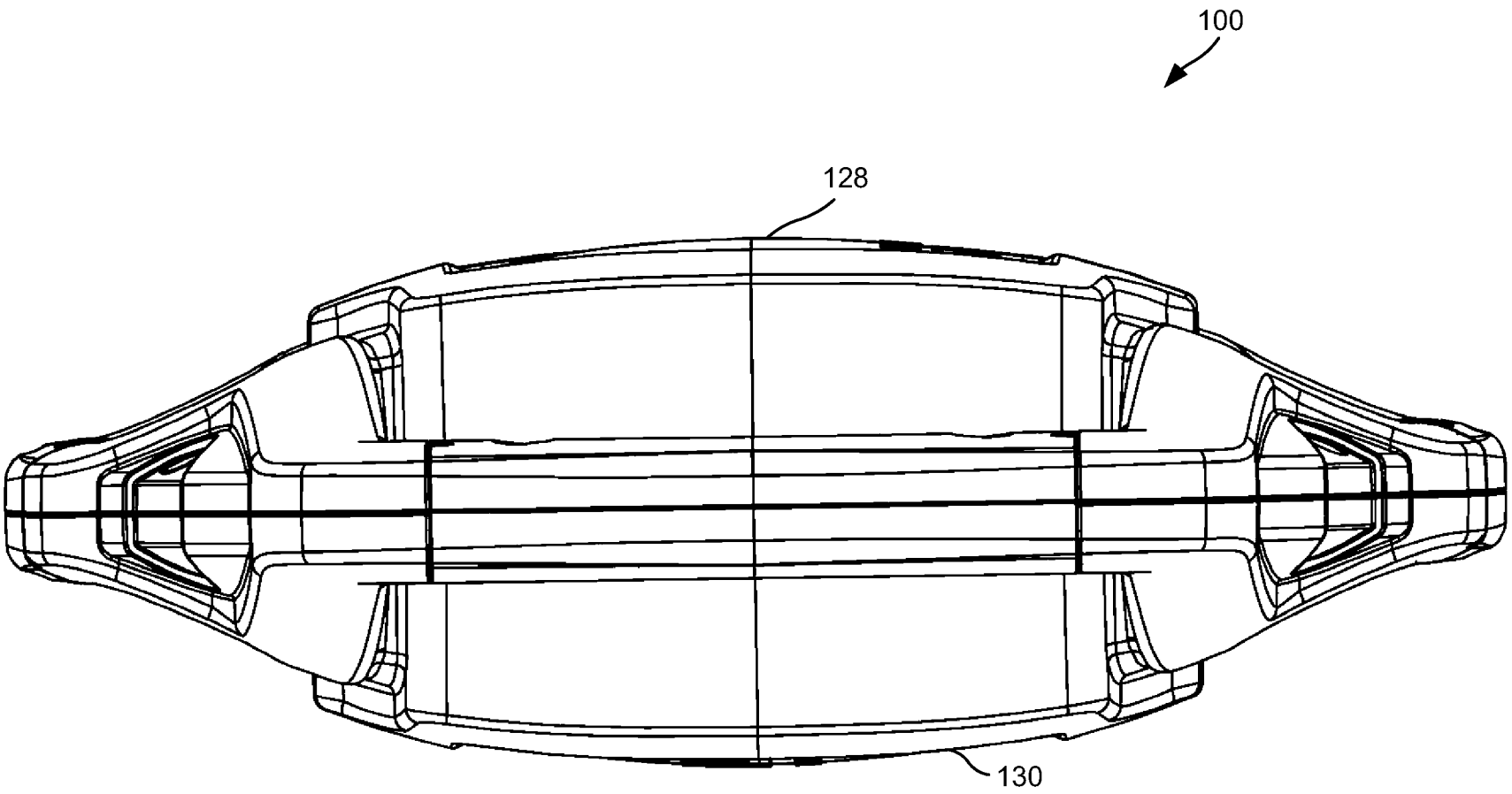
FIG. 2 illustrates a side view of one embodiment of the fitness device.

With reference now to FIG. 2, a side view of one embodiment of the fitness device 100, the clamshell housing 102 is formed from the mating of a front portion 128 and a back portion 130. The front portion 128 and the back portion 130 mate together so as to form and/or define an internal volume of the clamshell housing 102. The front portion 128 and the back portion 130 can be held in a mating configuration. In some embodiments, the front portion 128 and the back portion 130 are held in the mating configuration via one or several mechanical fasteners, which mechanical fasteners can be permanent and/or non-permanent. Thus, in some embodiments, the front portion 128 and the back portion 130 are connected via a plurality of mechanical fasteners. In some embodiments, these fasteners can include, for example, one or several screws, nuts, bolts, clips, locks, rivets, threaded members, adhesives, welded joints, or the like.

Figure 3:
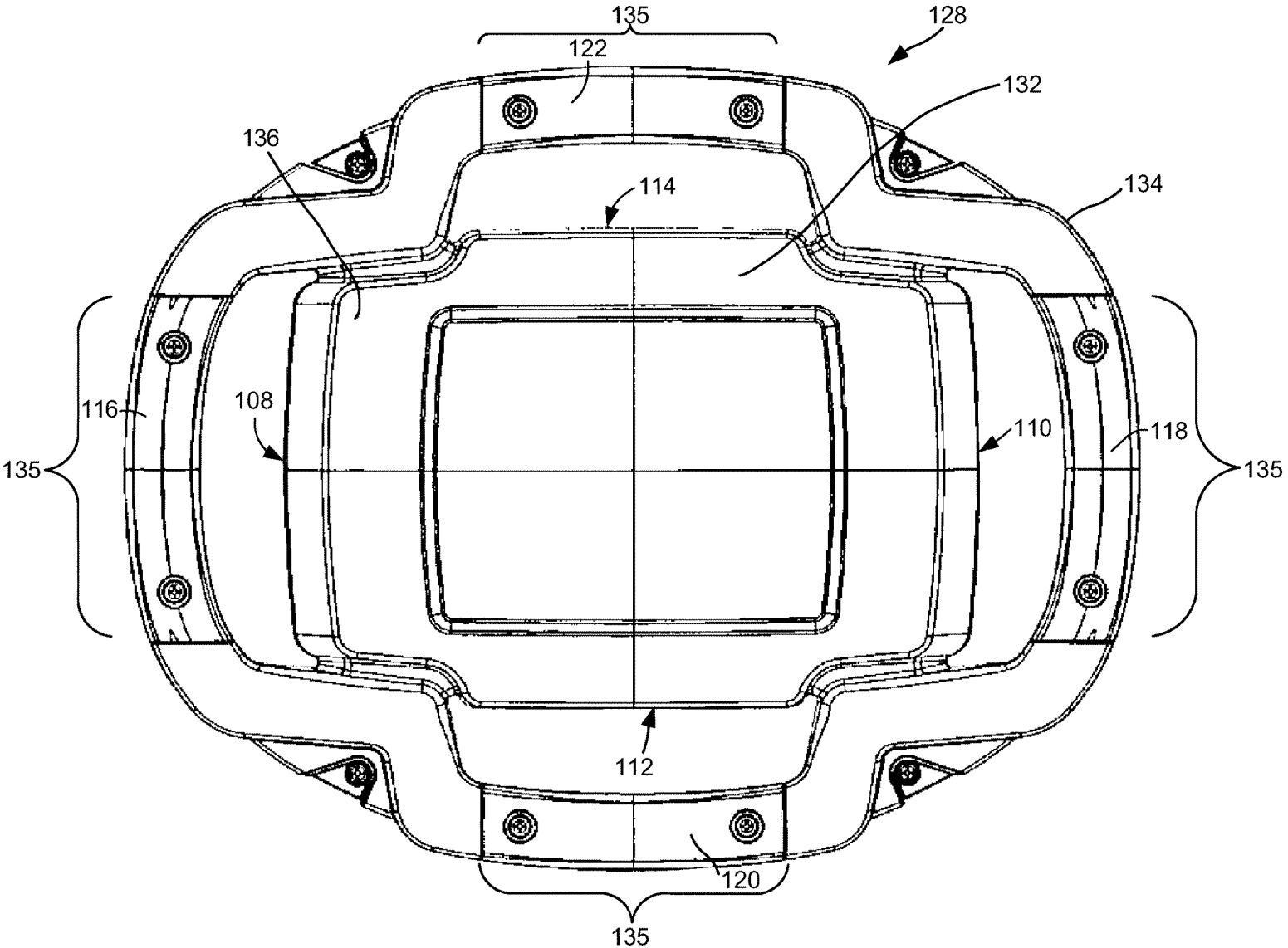
FIG. 3 is a top view of a front portion of the fitness device.

A top view of one embodiment of the front portion 128 is shown in FIG. 3. The front portion 128 includes a front body portion 132 and first handle portions 134 extending circumferentially around the front body portion 132. Specifically, as seen in FIG. 3, the handle portions 134 circumferentially extend around the body portion 132 such that a part of the first handle portions 134 are proximate to each of the first side 108, the second side 110, the third side 112, and the fourth side 114. The first handle portions 134 further include a plurality of gripping regions 135. As further seen, each of the grips 116, 118, 120, 122 are located on the first handle portions 134, and specifically, each of the grips 116, 118, 120, 122 is located on a gripping region 135. In some embodiments, some or all of the grips 116, 118, 120, 122 can comprise rubber handgrips that can cover all or portions of the gripping region 135 associated with each of the grips 116, 118, 120, 122.

Figure 4:
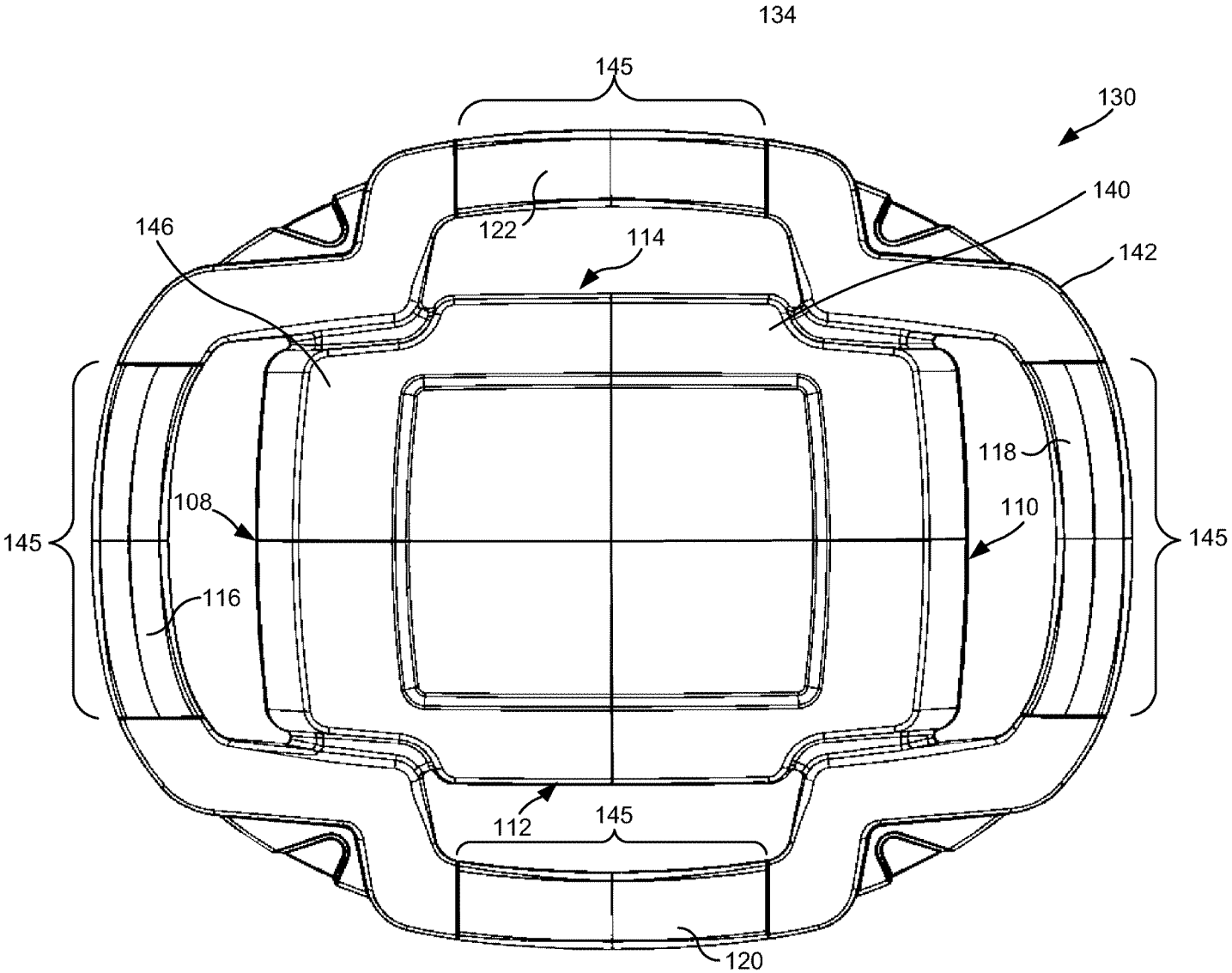
FIG. 4 is a bottom view of a back portion of the fitness device.

A bottom view of one embodiment of the back portion 130 is shown in FIG. 4. The back portion 130 includes a back body portion 140 and second handle portions 142 extending circumferentially around the back body portion 140. Specifically, as seen in FIG. 4, the second handle portions 142 circumferentially extend around the back body portion 140 such that a part of the second handle portions 142 are proximate to each of the first side 108, the second side 110, the third side 112, and the fourth side 114. The second handle portions 142 further include a plurality of gripping regions 145. As further seen, each of the grips 116, 118, 120, 122 are located on the second handle portions 142, and specifically, each of the grips 116, 118, 120, 122 is located on a gripping region 145. In some embodiments, some or all of the grips 116, 118, 120, 122 can comprise rubber handgrips that can cover all or portions of the gripping region 145 associated with each of the grips 116, 118, 120, 122. In some embodiments, when the front portion 128 and the back portion 130 are mated, the first and second handle portions 134, 142 likewise mate together to define a plurality of handles 148, each of the handles including a gripping region 145 and a grip 116, 118, 120, 122. In some embodiments, each of the first handle portions 134 and the second handle portions 142 comprise four gripping regions 135, 145, and in some embodiments, each of these four gripping regions 135, 145 of each of the first handle portions 134 and the second handle portions 142 are at least partially covered by one of the plurality of rubber handgrips.

The front portion 128 further includes a front external surface 136 and a front internal surface. The front external surface 136 is convex, and the front internal surface is concave. The back portion 130 likewise includes a back external surface 146 and a back internal surface. The back external surface 146 is convex, and the front internal surface is concave.

Figure 5:
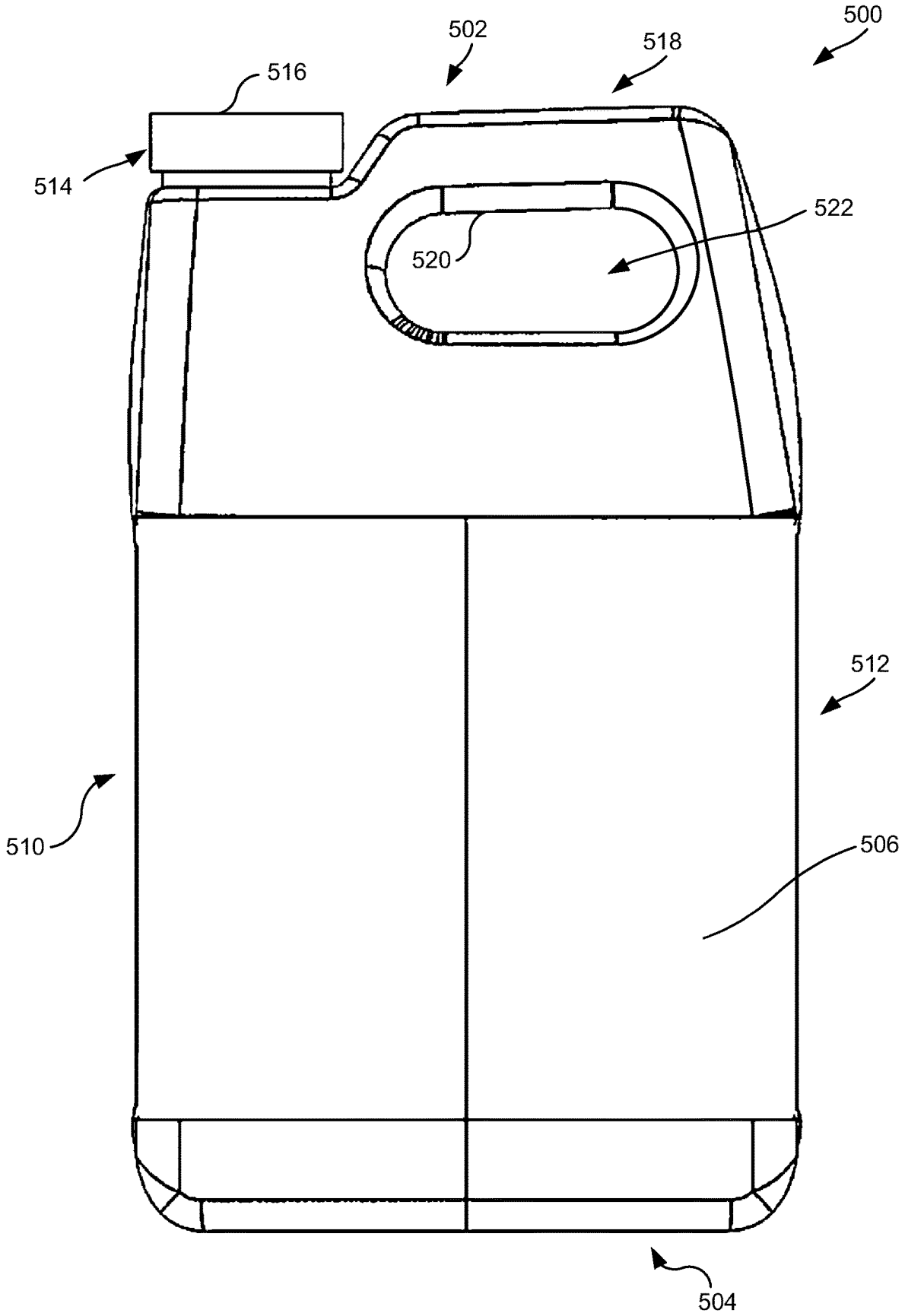
FIG. 5 is a front view of one embodiment of a sealed container.
Figure 6:
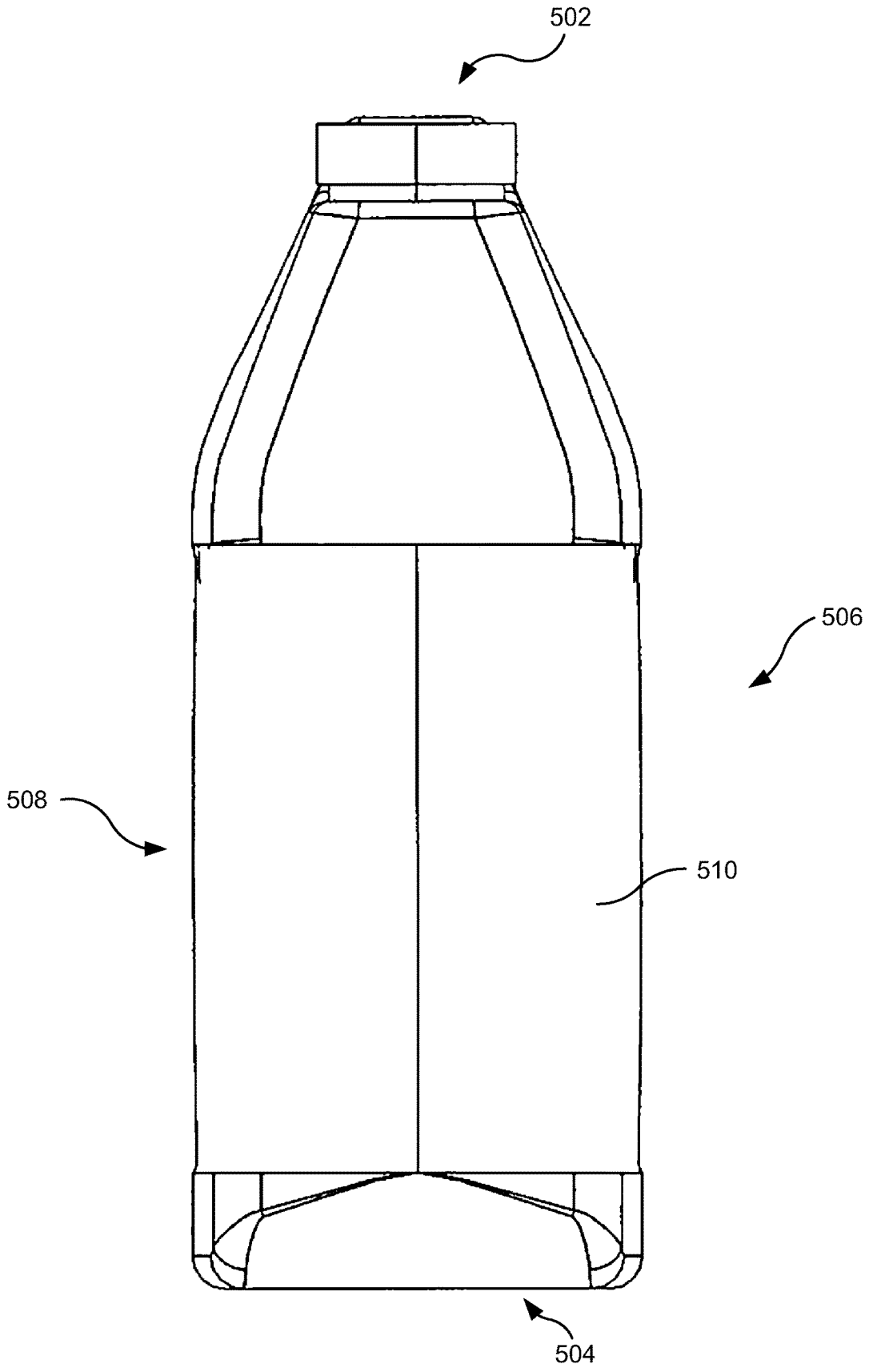
FIG. 6 is a side view of one embodiment of the sealed container.

With reference now to FIG. 5, a front-view of one embodiment of a sealed container 500 is shown. The sealed container 500 can be received within the clamshell housing 102, and specifically in the internal volume defined by the clamshell housing 102. In some embodiments, the sealed container 500 can be a 64 ounce bottle and/or can hold 64 ounces of water. The sealed container 500 can include a top 502, a bottom 504, a front 506, a back 508 (shown in FIG. 6), a left side 510, and a right side 512. In some embodiments, the bottom 504 can be flat, and in some embodiments, the bottom 504 can be concave.

The sealed container 500 defines a fluid chamber that can contain one or several substances. In some embodiments, the fluid chamber of the sealed container can contain a gaseous component and a fluid. In some embodiments, the liquid can fill a desired portion of the fluid chamber. In some embodiments, for example, the liquid can fill between approximately 40 percent and 90 percent of the liquid chamber, between approximately 45 percent and 80 percent of the liquid chamber, between approximately 50 percent and 70 percent of the liquid chamber, between approximately 60 percent and 65 percent of the liquid chamber, or between any other or intermediate percentages of the liquid chamber.

The fluid can include a first fluid component and a second fluid component. In some embodiments, the gaseous component can be air, or any other gas. In some embodiments, the first liquid component can be a liquid have a first density and the second liquid component can be a liquid having a second density, and/or in some embodiments, the first liquid component and the second liquid component are immiscible. In some embodiments, the first liquid component can comprise water and the second liquid component can comprise an oil such as, for example, mineral oil.

In some embodiments, the fluid can have a mixture ratio of between 1 part of the first fluid component to 1 part of the second fluid component and 10 parts of the first fluid component to 1 part of the second fluid component, between 2 parts of the first fluid component to 1 part of the second fluid component and 8 parts of the first fluid component to 1 part of the second fluid component, between 3 parts of the first fluid component to 1 part of the second fluid component and 5 parts of the first fluid component to 1 part of the second fluid component, and/or between any other or intermediate mixture ratios. In some embodiments, the fluid can have a mixture ratio of approximately 4 parts of the first fluid component to 1 part of the second fluid component. As used herein, "approximately" defines a range of +/−10 percent about the therewith associated value.

The sealed container 500 includes an opening 514, also referred to herein as a mouth 514, that can be sealed with a seal, a support member, and a cap 516. In some embodiments, the seal can be a heat seal that can seal the mouth 514 of the sealed container 500. The cap 516 can be positioned over the mouth 514 of the sealed container 500, and can be positioned over the seal, to thereby protect the seal. In some embodiments, the support member can be positioned between the cap 516 and the seal, and the support member can comprise, for example, a disc-shaped member inserted into the cap 516 that can transfer forces applied to the seal by the fluid in the sealed container 500 to the cap 516 to thereby prevent the failure of the seal. The support can comprise a pulp support, a metal support such as an aluminum support, or the like. In some embodiments, the cap 516 can threadingly engage with the mouth 514 of the sealed container 500. In some embodiments, the cap 516 can be sealed to the sealed container 500 and/or can be fused to the sealed container 500.

The sealed container 500 can further include a handle portion 518 that can be located at the top 502 of the sealed container 500 and/or can be located proximate to the top 502 of the sealed container 500. The handle portion 518 can include a plurality of interior surfaces 520 that can define a gripping orifice 522.

Figure 7:
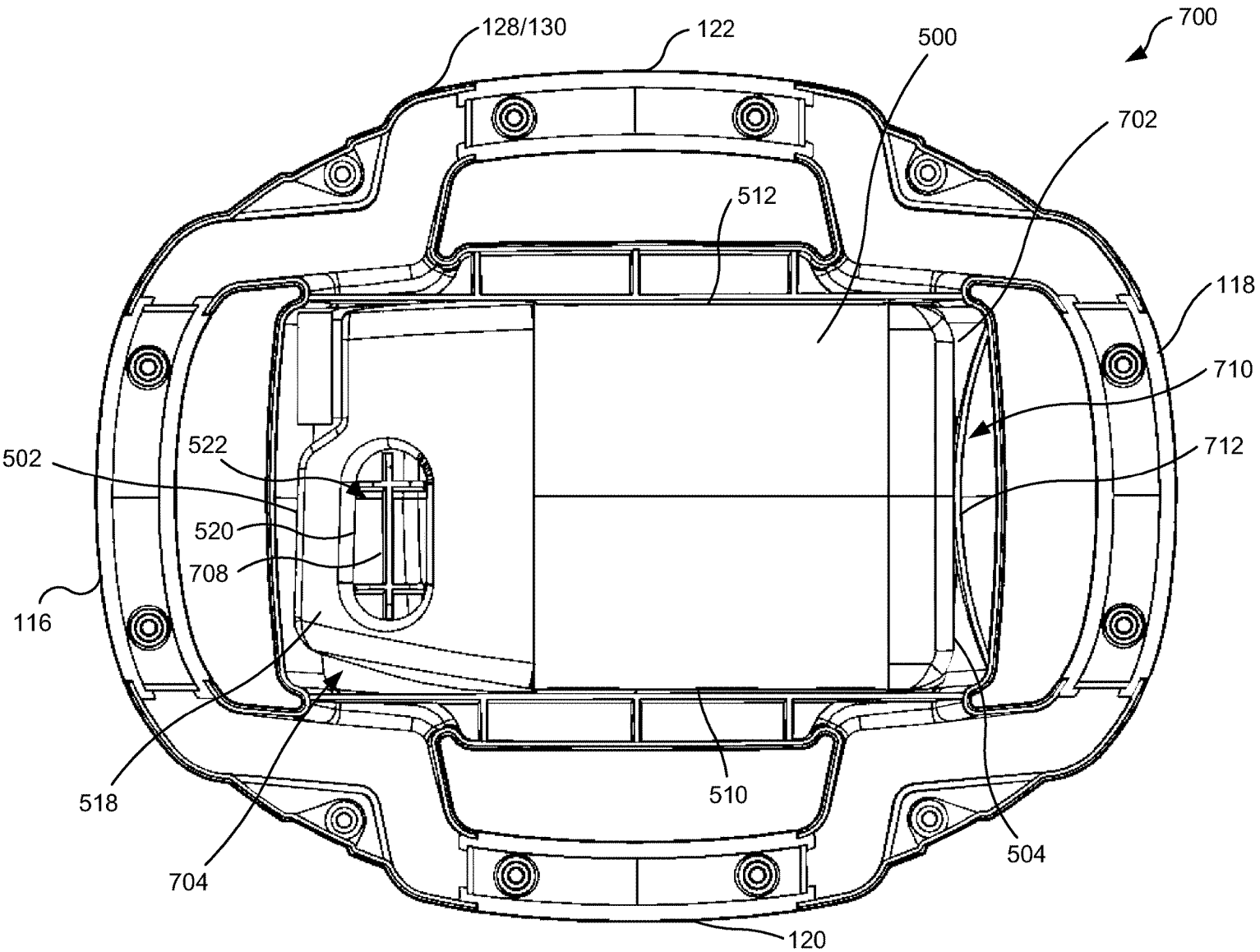
FIG. 7 is a view of one embodiment of the sealed container within one of the front portion or the back portion.

With reference now to FIG. 7, a view of the interior 700 of one or both of the front portion 128 and the back portion 130. Each of the front portion 128 and the back portion 130 comprise an internal surface 702. In some embodiments, the front internal surface and the back internal surface are identical and/or are mirrors of each other.

The internal surface 702 can define the internal volume 704 of the clamshell housing 102, and specifically, the internal surfaces 702 of the front and back portions 128, 130 can together define the internal volume 704. The internal volume 704 can fixedly receive the sealed container 500.

As further seen in FIG. 7, the internal surface 702 can include one or several engagement features, which can engage with a portion of the sealed container 500 to fix a position of the sealed container 500 with respect to the clamshell housing 102, and specifically with respect to the internal volume 704 of the clamshell housing 102. In some embodiments, the engagement feature can include a handle-portion feature 708. The handle portion feature 708 can engage with the handle portion 518 of the sealed container 500, and specifically, the handle portion feature 708 can at least partially insert into the gripping orifice 522 of the handle portion 518. In some embodiments, when inserted into the gripping orifice 522, the handle portion feature 708 can engage with some or all of the interior surfaces 520 defining the gripping orifice 522 to thereby fix the position of the sealed container 500.

The engagement feature can further include a base feature 710. The base feature 710 can, in some embodiments, engage with at least a portion of the bottom 504 of the sealed container 500. In some embodiments, the base feature 710 can comprise a curved member 712 that can be, in some embodiments, dome-shaped. The curved member 712 can be arched towards and engaged with the bottom 504 of the sealed container. In some embodiments, when received within the internal volume 704, the curved member 712 can at least partially deform the bottom 504 of the sealed container 500. In some embodiments, this deformation of the bottom 504 of the sealed container 500 can fix and/or partially fix the sealed container 500 within the internal volume 704.

Figure 8:
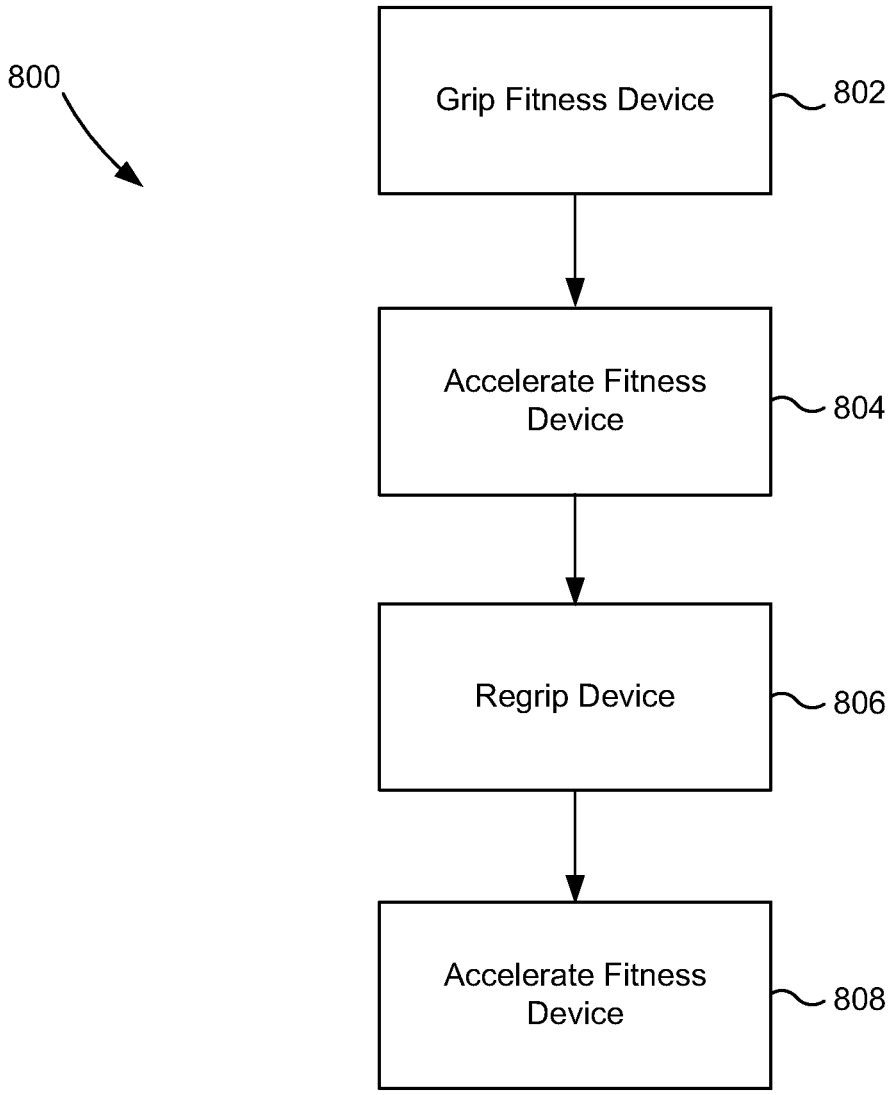
FIG. 8 is a flowchart illustrating one embodiment of a process for using the fitness device.

FIG. 8 is a flowchart illustrating one embodiment of a process 800 for using the fitness device 100. The process 800 begins at block 802, wherein the fitness device 100 is gripped. In some embodiments, this can include gripping at least one of the first grip 116, the second grip 118, the third grip 120, and the fourth grip 122. In some embodiments, this gripping can include gripping two of the first grip 116, the second grip 118, the third grip 120, and the fourth grip 122, and specifically gripping a pair grips including either the first grip 116 and the second grip 118, or the third grip 120 and the fourth grip 122.

At block 804, the fitness device 100 is accelerated, and in some embodiments, is repeatedly accelerated. This repeated acceleration can include accelerations and decelerations. In some embodiments, this repeated acceleration of the fitness device 100 generates dynamic force via movement of the fluid within the fluid chamber of the sealed container 500. In some embodiments, for example, the acceleration of the fitness device 100 can result in the movement of the fluid within the fluid chamber of the sealed container 500. In some embodiments, for example, the movement of the fluid within the fluid chamber of the sealed container 500 can generate centrifugal forces that are applied to the athlete using the fitness device 100. In some embodiments, these dynamic forces can increase as the magnitude and frequency of the repeated accelerations increases.

At block 806, the fitness device 100 can be regripped. In some embodiments, this can include releasing current grips on the fitness device 100 and gripping another of the first grip 116, the second grip 118, the third grip 120, and the fourth grip 122, and/or gripping another pair of grips from the first grip 116, the second grip 118, the third grip 120, and the fourth grip 122. In some embodiments in which the athlete gripped the first grip 116 and the second grip 118 in step 802, the regripping can include releasing the first grip 116 and the second grip 118, and gripping the third grip 120 and the fourth grip 122.

At block 808, the fitness device 100 is again accelerated, and in some embodiments, is again repeatedly accelerated. This acceleration can be performed while the athlete is gripping the fitness device 100 as regripped. In some embodiments, the regripping of the fitness device 100 results in the generation of different forces and/or the athlete experiencing different forces than before the regripping of the fitness device 100.

In the foregoing specification, the invention is described with reference to specific embodiments thereof, but those skilled in the art will recognize that the invention is not limited thereto. Various features and aspects of the above-described invention can be used individually or jointly. Further, the invention can be utilized in any number of environments and applications beyond those described herein without departing from the broader spirit and scope of the specification. The specification and drawings are, accordingly, to be regarded as illustrative rather than restrictive. It will be recognized that the terms "comprising," "including," and "having," as used herein, are specifically intended to be read as open-ended terms of art.

What is claimed is:

1. A fitness device comprising:

a clamshell housing comprising:

a front portion;

a back portion, wherein the front portion and the back portion mate together to define an internal volume;

first handle portions extending circumferentially around the front portion;

second handle portions extending circumferentially around the back portion, wherein the first and second handle portions mate together with the mating of the front portion and the back portion to define a plurality of handles;

a sealed container defining a fluid chamber, the sealed container fixedly received within the internal volume defined by the front portion and the back portion of the clamshell housing, the fluid chamber of the sealed container containing: a gaseous component, a first fluid component, and a second fluid component;

wherein the first fluid component comprises water, and wherein the second fluid component comprises mineral oil.

2. The fitness device of claim 1, wherein the sealed container contains a mixture of the first fluid component and the second fluid component in a ratio of 4 parts of the first fluid component to 1 part of the second fluid component.

3. The fitness device of claim 1, wherein the first fluid component and the second fluid component together fill between 50 percent and 70 percent of the fluid chamber of the sealed container.

4. The fitness device of claim 1, wherein the sealed container comprises: a bottle; a seal and a cap.

5. The fitness device of claim 4, wherein the cap is fused to the bottle.

6. The fitness device of claim 1, wherein the front portion comprises a front external surface and a front internal surface, and wherein the back portion comprises a back external surface and a back internal surface.

7. The fitness device of claim 6, wherein each of the front external surface and the back external surface are convex and wherein each of the front internal surface and the back internal surface are concave.

8. The fitness device of claim 7, wherein at least one of the front internal surface and the back internal surface comprise an engagement feature engaged with a portion of the sealed container to fix a position of the sealed container with respect to the clamshell housing.

9. The fitness device of claim 8, wherein the sealed container comprises a top and a bottom, wherein the top of the sealed container comprises a handle portion.

10. The fitness device of claim 9, wherein the handle portion comprises interior surfaces defining a gripping orifice.

11. The fitness device of claim 10, wherein the engagement feature comprises a handle-portion feature.

12. The fitness device of claim 11, wherein the handle-portion feature at least partially inserts into the gripping orifice and engages with at least some of the interior surfaces defining the gripping orifice.

13. The fitness device of claim 12, wherein the engagement feature further comprises a base feature engaged with at least a portion of the bottom of the sealed container.

14. The fitness device of claim 13, wherein the base feature comprises a curved member arched towards and engaged with the bottom of the sealed container.

15. The fitness device of claim 14, wherein the curved member is dome-shaped.

16. The fitness device of claim 14, wherein the curved member at least partially deforms the bottom of the sealed container.

17. The fitness device of claim 14, wherein each of the first handle portions and the second handle portions comprises four gripping regions.

18. The fitness device of claim 17, further comprising a plurality of rubber handgrips, wherein each of the gripping regions is at least partially covered by one of the plurality of rubber handgrips.

19. The fitness device of claim 18, wherein the front portion and the back portion are connected via a plurality of fasteners.

* * * * *